US011624485B1

(12) United States Patent
Lai

(10) Patent No.: US 11,624,485 B1
(45) Date of Patent: Apr. 11, 2023

(54) ILLUMINATION SET AND ALPHABET LAMP

(71) Applicant: Peng Hsiang Lai, New Taipei (TW)

(72) Inventor: Peng Hsiang Lai, New Taipei (TW)

( * ) Notice: Subject to any disclaimer, the term of this patent is extended or adjusted under 35 U.S.C. 154(b) by 0 days.

(21) Appl. No.: 17/883,944

(22) Filed: Aug. 9, 2022

(51) Int. Cl.
*F21S 2/00* (2016.01)
*F21V 11/08* (2006.01)
*F21V 23/06* (2006.01)

(52) U.S. Cl.
CPC ..... *F21S 2/005* (2013.01); *F21V 11/08* (2013.01); *F21V 23/06* (2013.01)

(58) Field of Classification Search
CPC ..... F21S 2/005; F21V 11/08; F21V 23/06
See application file for complete search history.

(56) References Cited

U.S. PATENT DOCUMENTS 4,532,579 A * 7/1985 Merryman ..... G09F 13/0404 362/310
9,651,215 B1 * 5/2017 Britten ..... G09F 13/04
9,796,094 B1 * 10/2017 DePhillips ..... B25J 11/00

* cited by examiner

*Primary Examiner* — Anne M Hines
(74) *Attorney, Agent, or Firm* — Birch, Stewart, Kolasch & Birch, LLP

(57) ABSTRACT

An illumination set has a plurality of alphabet lamps and a plurality of connectors. Two of the alphabet lamps are connected by one of the connectors. Each alphabet lamp has a bottom casing, a top cover, an illumination circuit board, and a slide. The top cover is mounted on the bottom casing. The illumination circuit board is mounted in the bottom casing and between the top cover and the bottom casing. The illumination circuit board has an illumination component and a plurality of sockets. The slide is detachably mounted on the bottom casing. The top cover is located between the slide and the bottom casing. A pattern is formed on the slide. Because the slide of the alphabet lamp is detachable, the pattern on the alphabet lamp can be changed.

4 Claims, 20 Drawing Sheets

ILLUMINATION SET AND ALPHABET LAMP

BACKGROUND OF THE INVENTION

1. Field of the Invention

The present invention relates to an illumination device, especially to a mood lamp that is used for showing alphabets.

2. Description of the Prior Arts

Conventionally, mood lamps are disposed on a desk or a wall and configured to illuminate or create atmosphere. One kind of mood lamp is an alphabet lamp, which is capable of showing an alphabet when turned on. After arranged together, the multiple alphabet lamps may compose a word or even a sentence for a memorial day, a celebration, or displaying other information (e.g. welcome).

The current alphabet lamp may be categorized into two types: one is a box shaped as an alphabet and multiple illuminating units mounted in the box; the other one is light units covered by printed alphabets. However, such alphabet lamps have defects.

BOX SHAPED AS AN ALPHABET: every alphabet is made via a mold, which increases the cost and is hard to modify. Besides, even multiple such alphabet lamps can be connected, all alphabet lamps only can be turned on and off synchronously and cannot flicker individually. In other words, the connected alphabet lamps cannot be controlled individually. Besides, each alphabet needs different numbers of illuminate units to fill up its contour. Correspondingly, each alphabet need different circuit board to control the illuminate units, which increases the cost.

LIGHT UNITS COVERED BY PRINTED ALPHABETS: such alphabet lamp is printed or attached with a word or phrase during manufacture, so it only displays specific information. In other words, the alphabet lamp must be used on a specific occasion or for displaying specific information. The alphabets in the alphabet lamp cannot be added, replaced by other alphabets, or even changed in order, so the usage is limited.

To overcome the shortcomings, the present invention provides an illumination set and an alphabet lamp to mitigate or obviate the aforementioned problems.

SUMMARY OF THE INVENTION

The main objective of the present invention is to provide an illumination set which has multiple alphabet lamps, and each one of the alphabet lamps has a replaceable slide so that the usage of the alphabet lamps is specified.

The illumination set has a plurality of alphabet lamps and a plurality of connectors. Two of the alphabet lamps are connected by one of the connectors.

Each one of alphabet lamps has a bottom casing, a top cover, an illumination circuit board, and a slide. The top cover is mounted on the bottom casing. The illumination circuit board is mounted in the bottom casing and between the top cover and the bottom casing. The illumination circuit board has an illumination component and a plurality of sockets. The slide is detachably mounted on the bottom casing. The top cover is located between the slide and the bottom casing. A pattern formed on the slide.

The alphabet lamp in another configuration has an illumination module and a plurality of female ports mounted on sides of the illumination module. The illumination module has a top cover, a slide, a bottom casing, an illumination circuit board, and a plurality of connecting holes. The slide is detachably mounted on the top cover and a pattern is formed on the slide. The bottom casing engages with the top cover. The illumination circuit board is located between the top cover and the bottom casing and mounted in the bottom casing. A plurality of the alphabet lamps are configured to be connected by a plurality of connectors to transmit power and signals, and each one of the connectors is made from a wire, a rigid printed circuit board, or a flexible printed circuit board.

Because the slide of the alphabet lamp is detachable, the user can prepare many slides with different patterns, and then mount the suitable slide to display various information. Therefore, the illumination set and the alphabet lamps may not be limited to any specific information or situation, which lowers the cost. Further, every alphabet lamp has the same structure and use the same circuit board to control same the illumination component, which lowers the cost.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
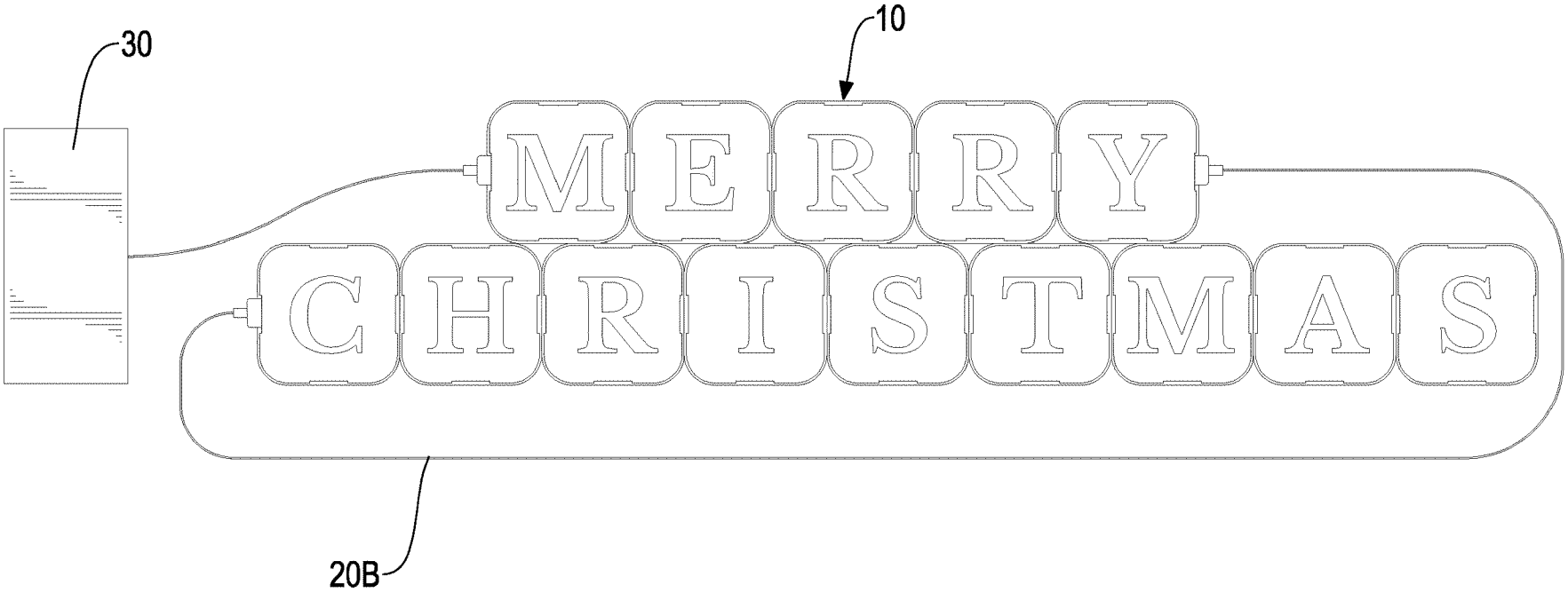
FIG. 1 is a front view of an illumination set in accordance with a configuration of the present invention.
Figure 2:
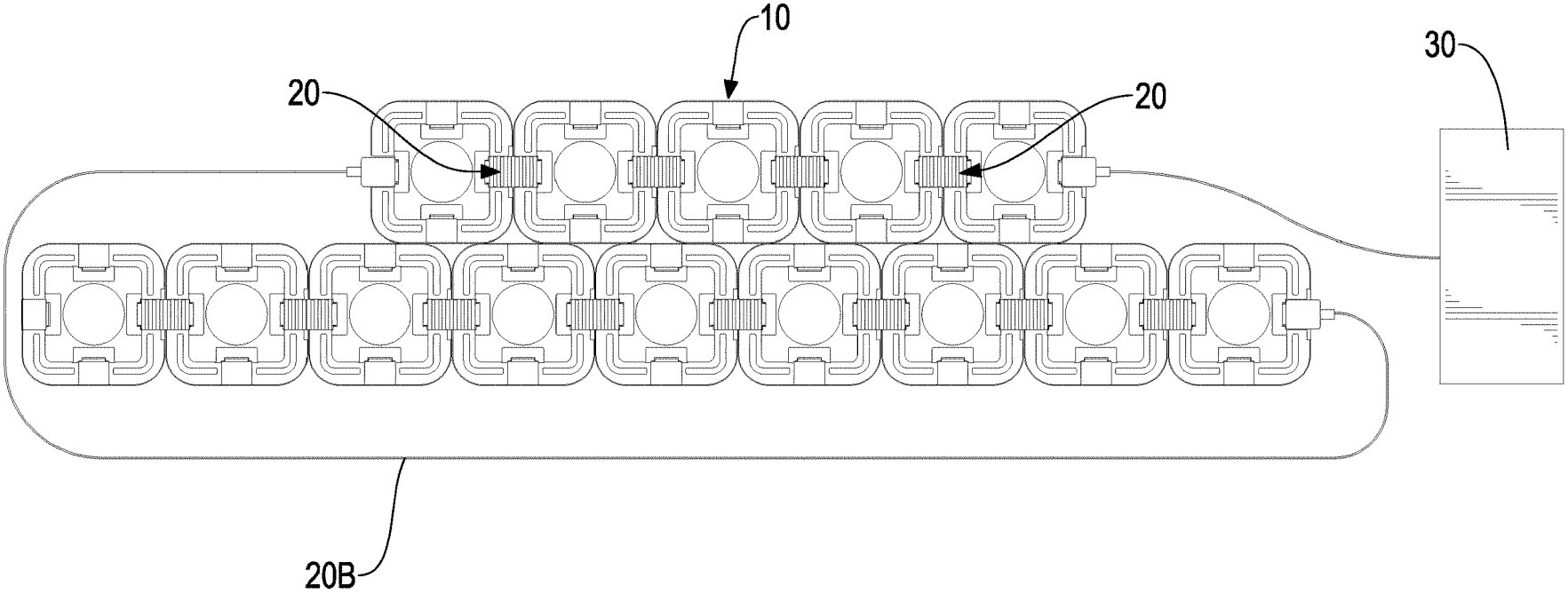
FIG. 2 is a rear view of the illumination set in FIG. 1.
Figure 3:
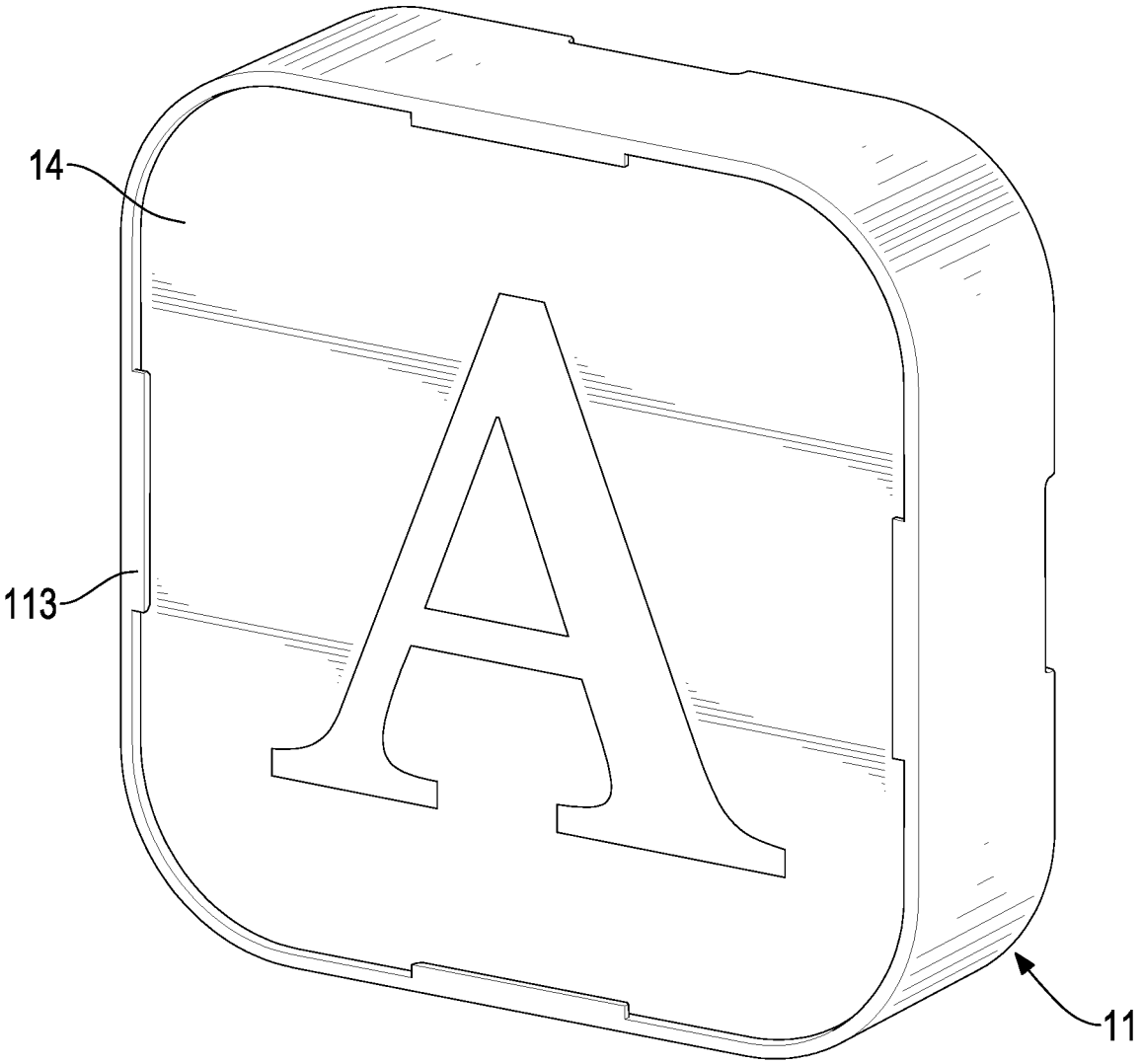
FIG. 3 is a perspective view of an alphabet lamp of the illumination set in FIG. 1.
Figure 4:
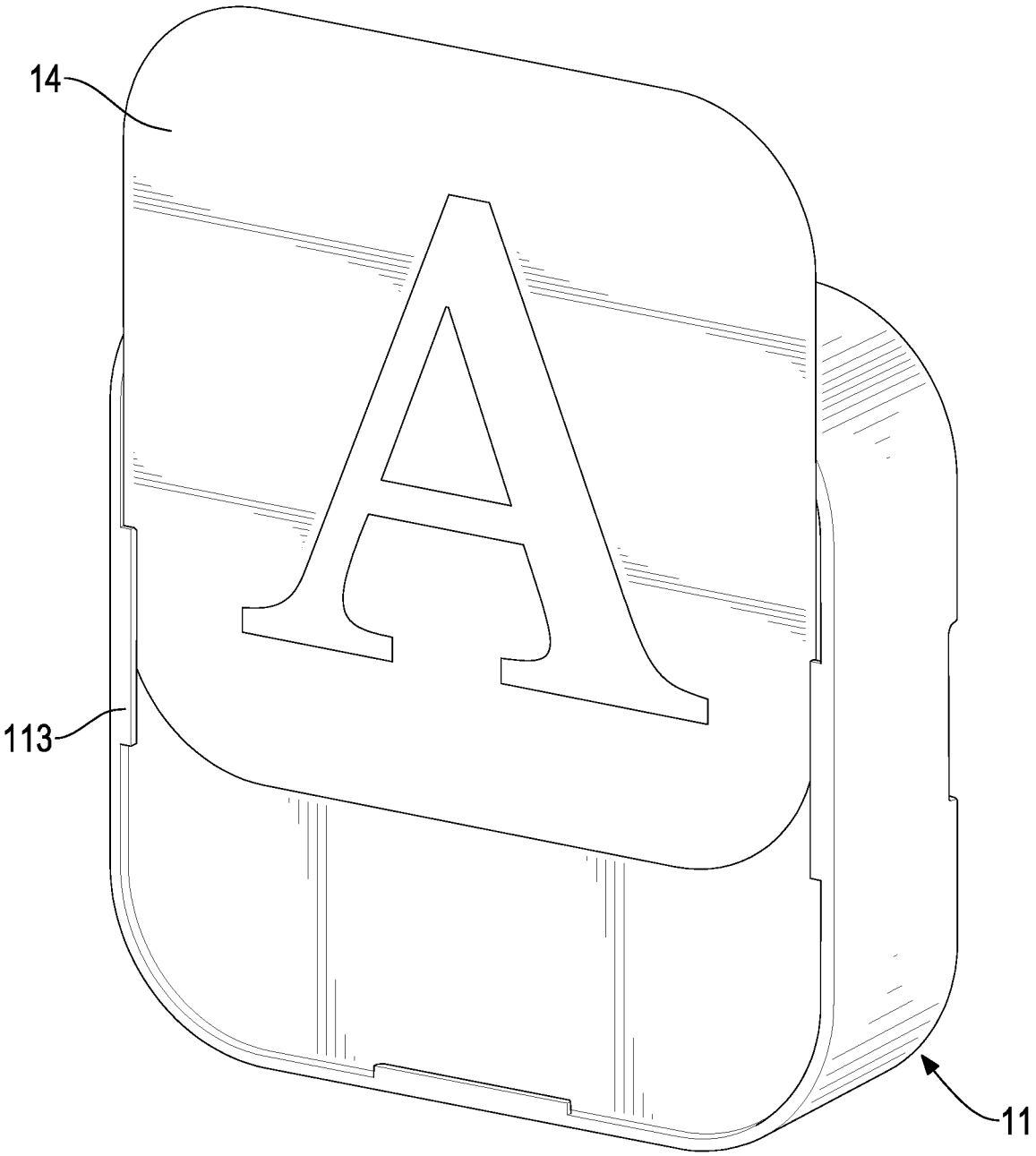
FIG. 4 is a perspective view of an alphabet lamp of the illumination set in FIG. 1, showing a slide of the alphabet lamp is detachable.
Figure 5:
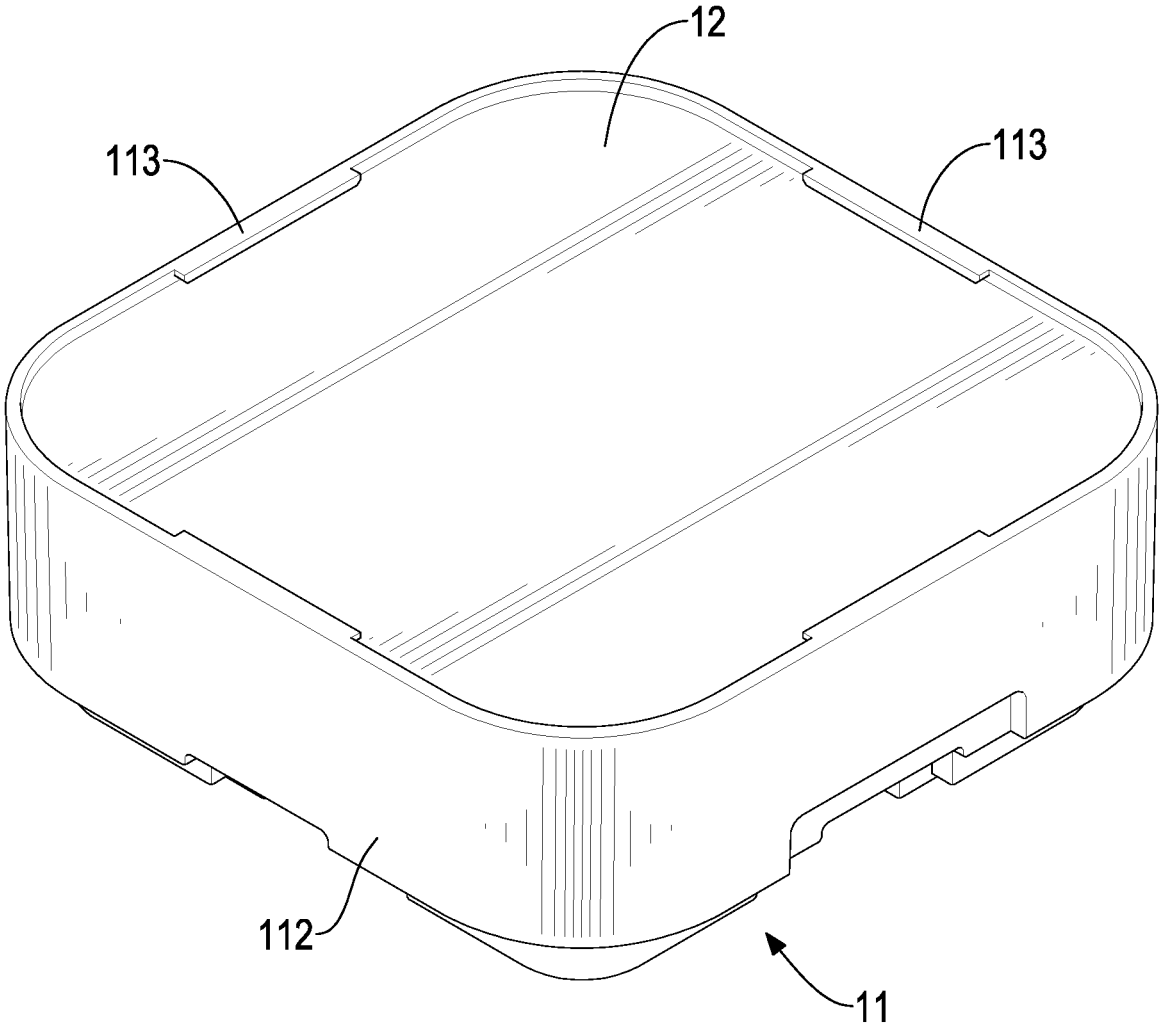
FIG. 5 is an upper perspective view of the alphabet lamp in FIG. 3.
Figure 6:
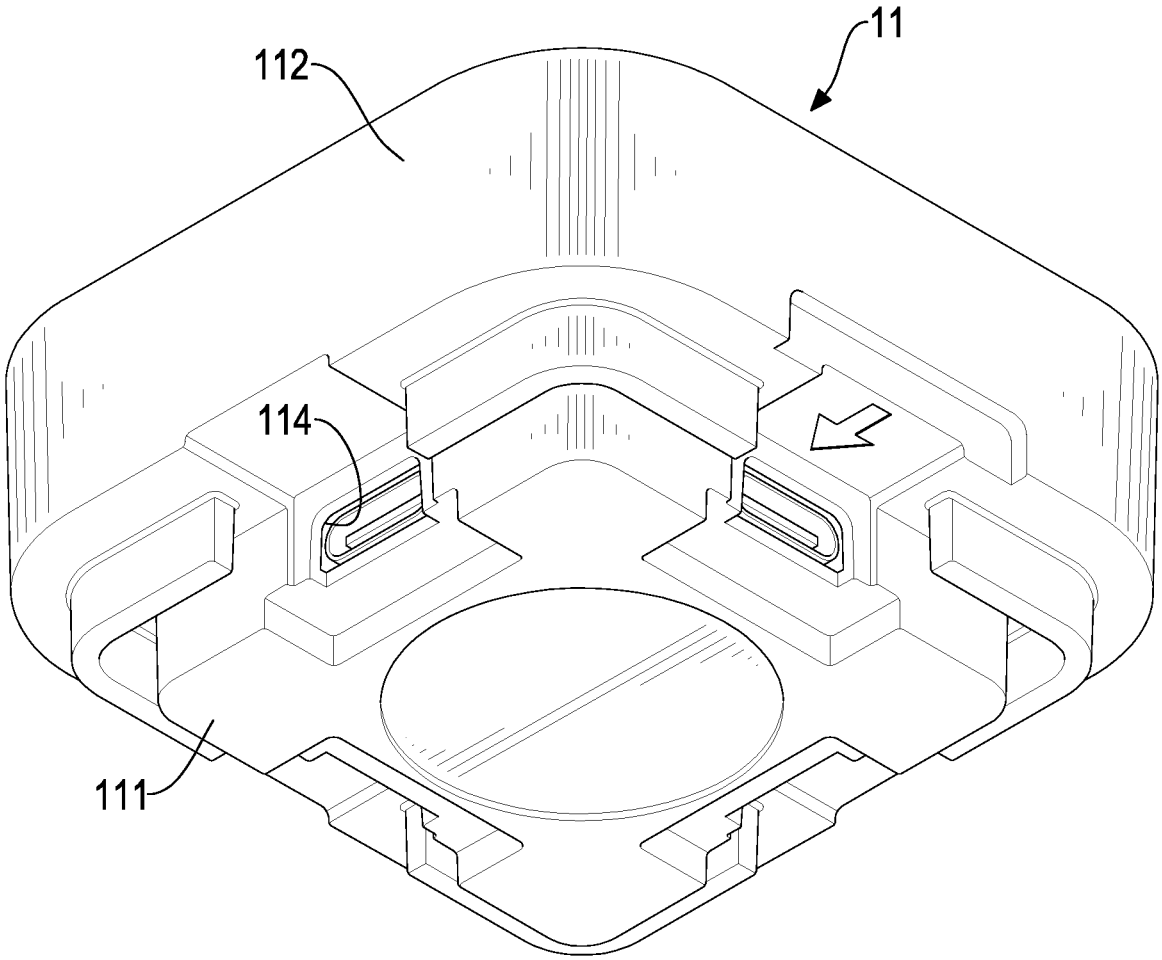
FIG. 6 is a lower perspective view of the alphabet lamp in FIG. 3.
Figure 7:
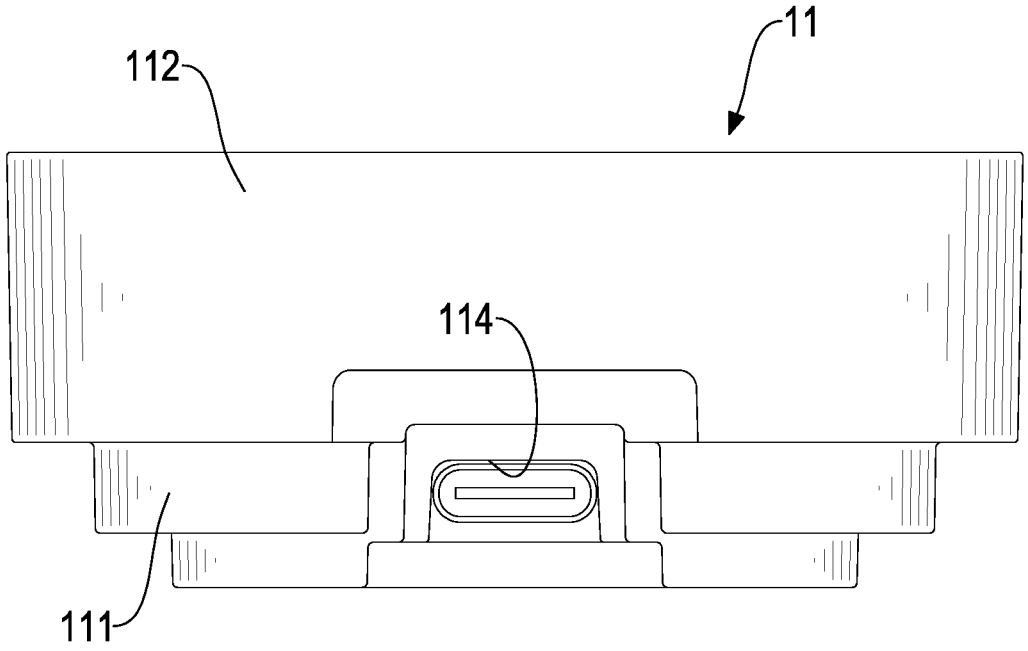
FIG. 7 is a side view of the alphabet lamp in FIG. 3.
Figure 8:
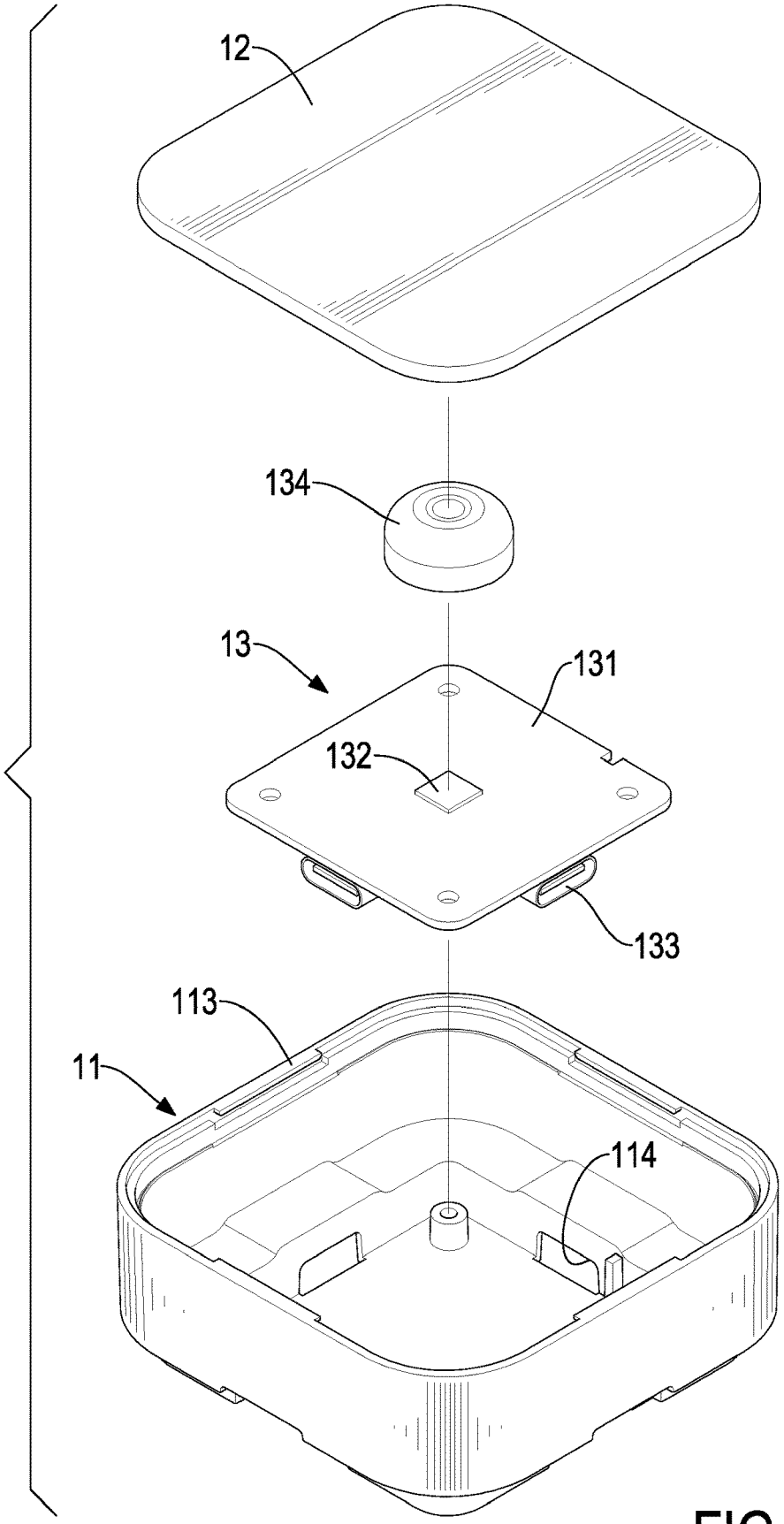
FIG. 8 is an upper exploded perspective view of the alphabet lamp in FIG. 5.
Figure 9:
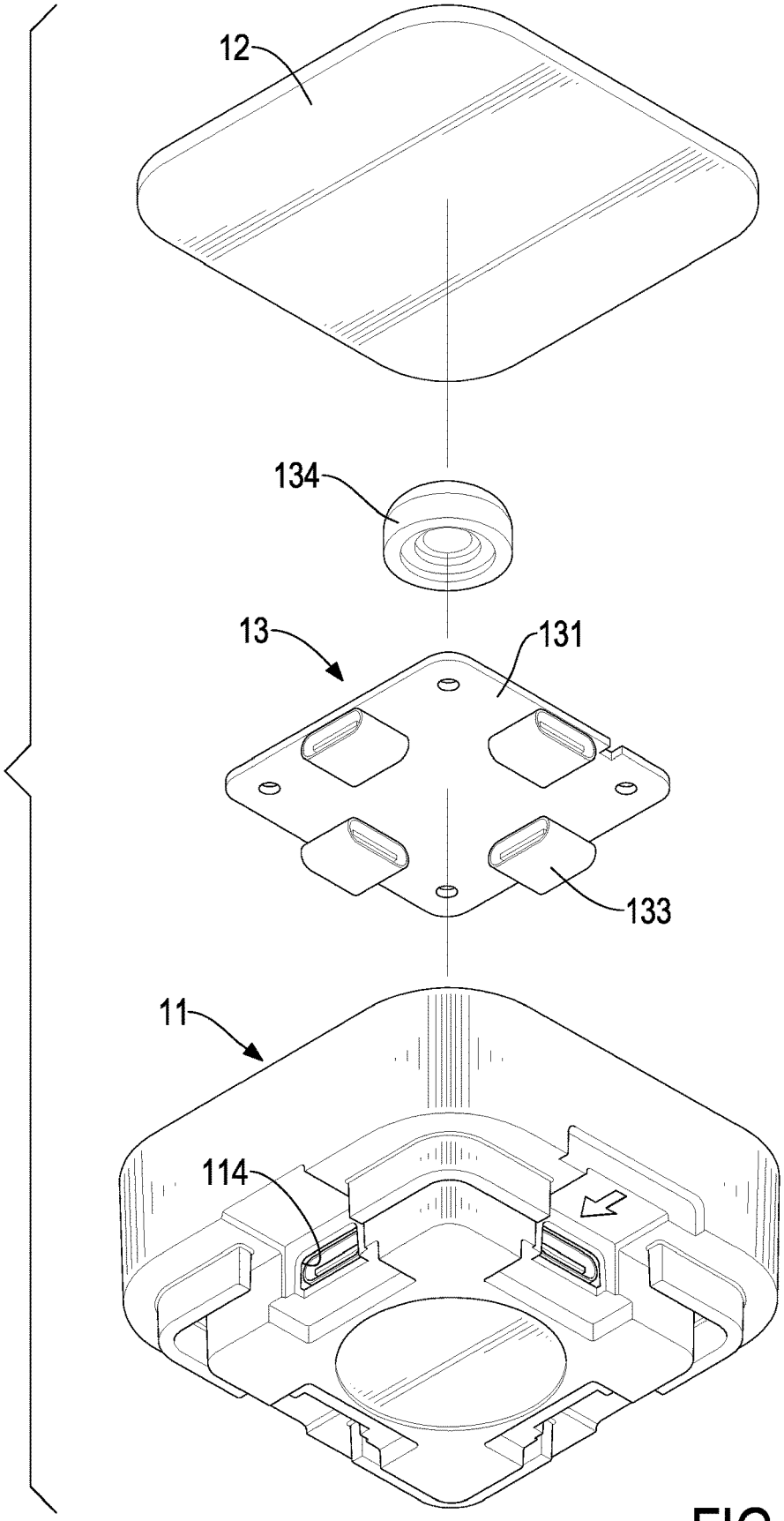
FIG. 9 is a lower exploded perspective view of the alphabet lamp in FIG. 5.
Figure 10:
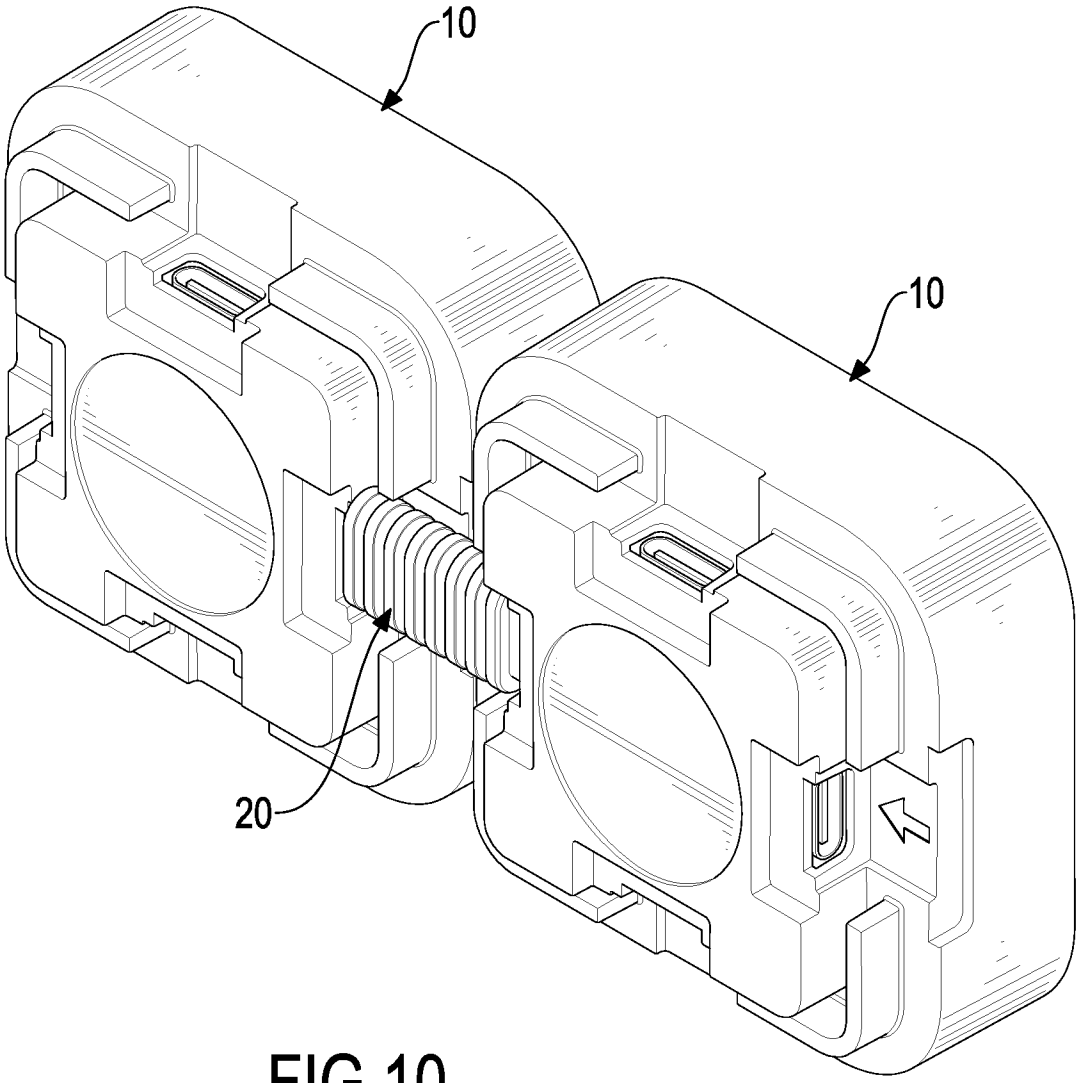
FIG. 10 is a perspective view of the illumination set in FIG. 1, showing two alphabet lamps connected by one connector.
Figure 11:
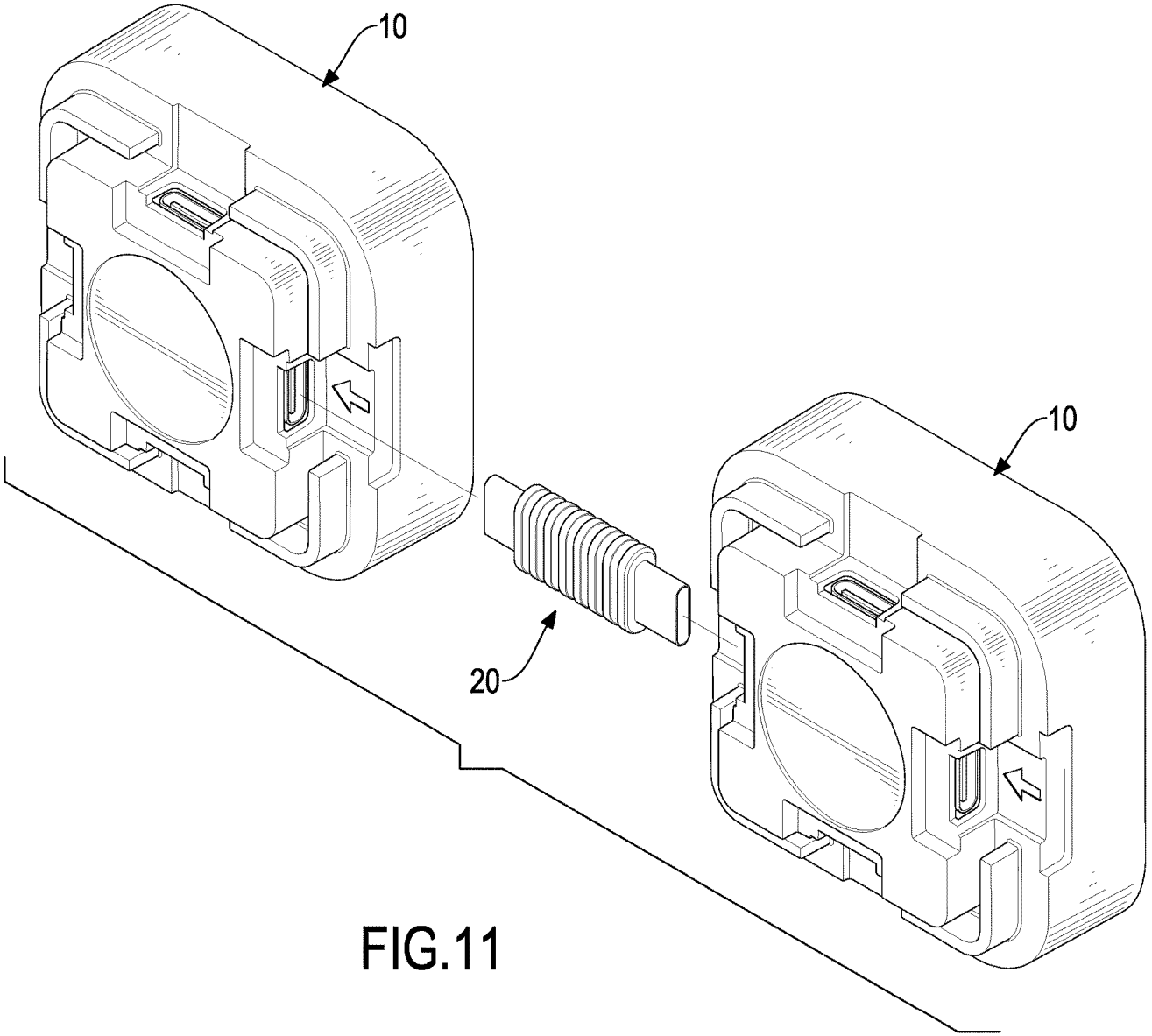
FIG. 11 is an exploded perspective view of the illumination set in FIG. 10.
Figure 12:
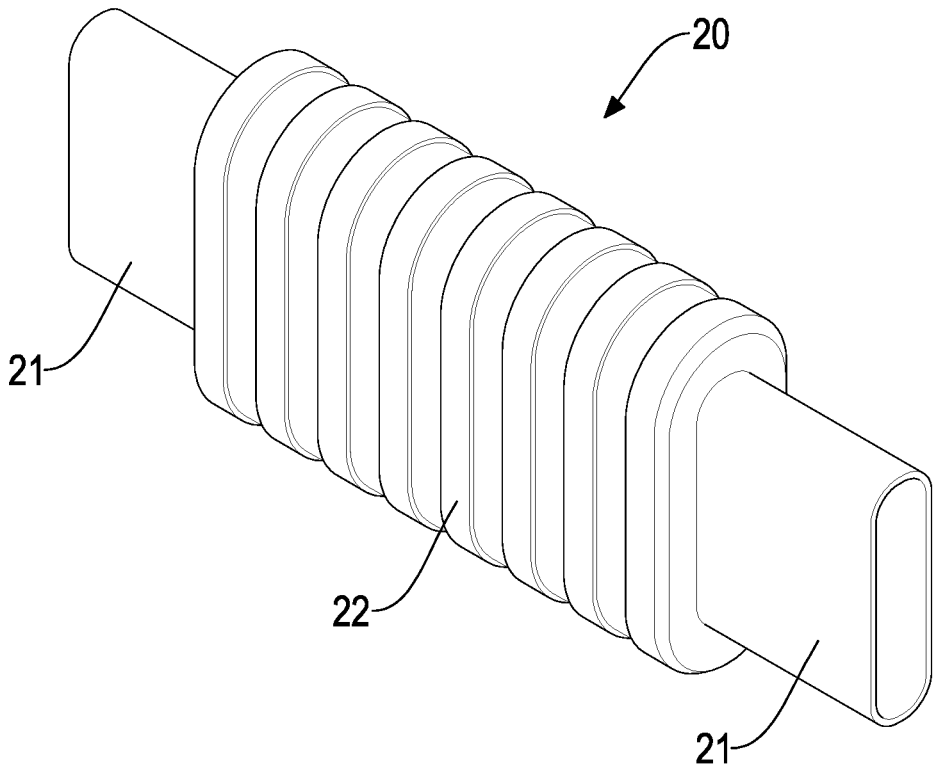
FIG. 12 is a perspective view of a connector of the illumination set in one configuration.
Figure 13:
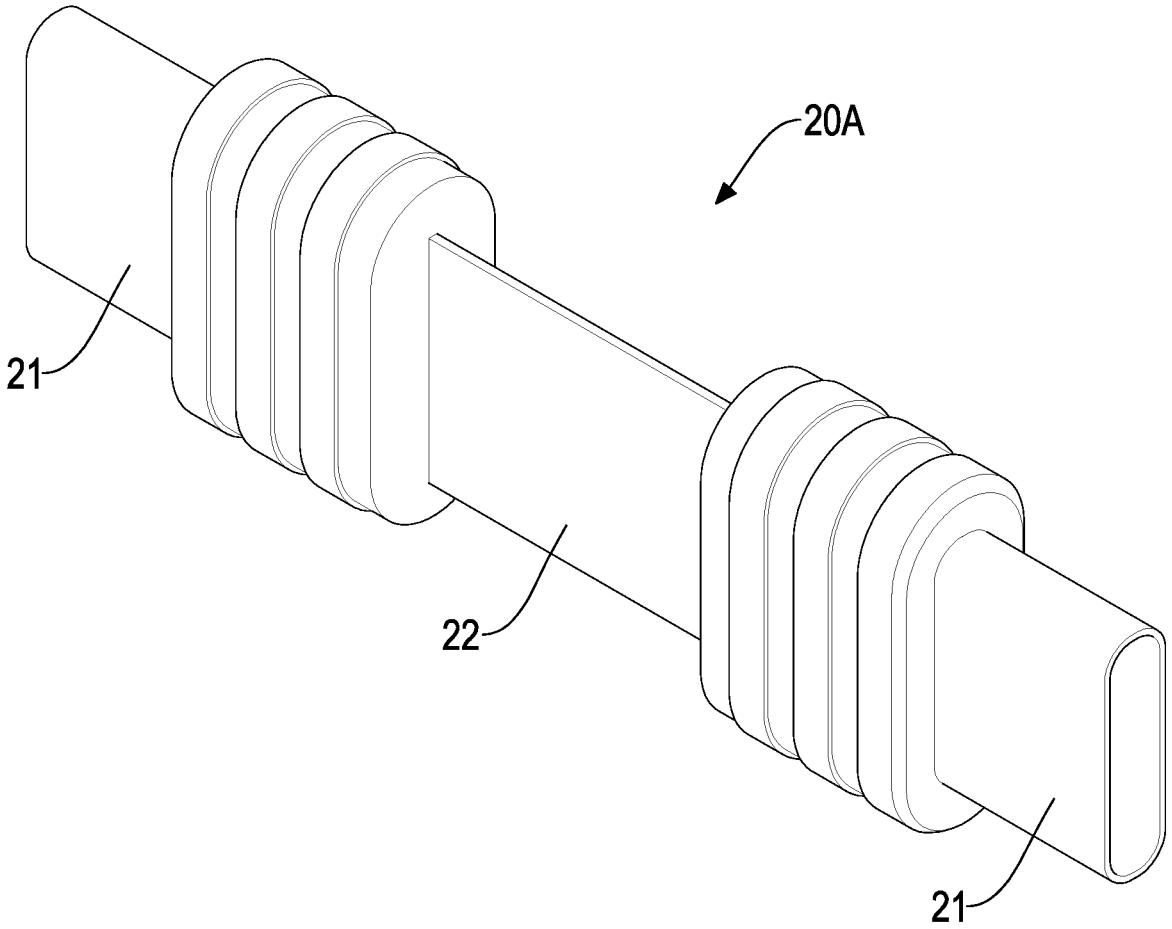
FIG. 13 is a perspective view of a connector of the illumination set in another configuration.
Figure 14:
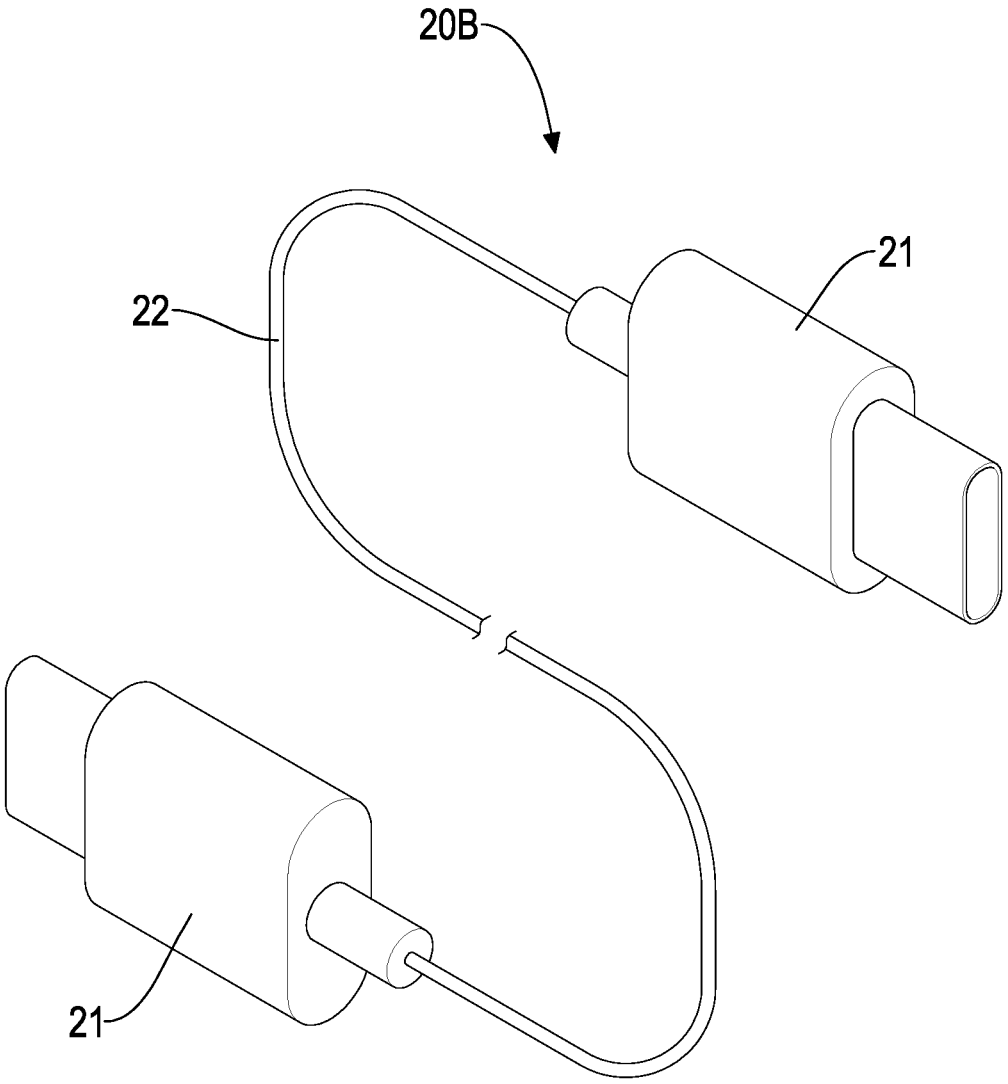
FIG. 14 is a perspective view of a connector of the illumination set in another configuration.
Figure 15:
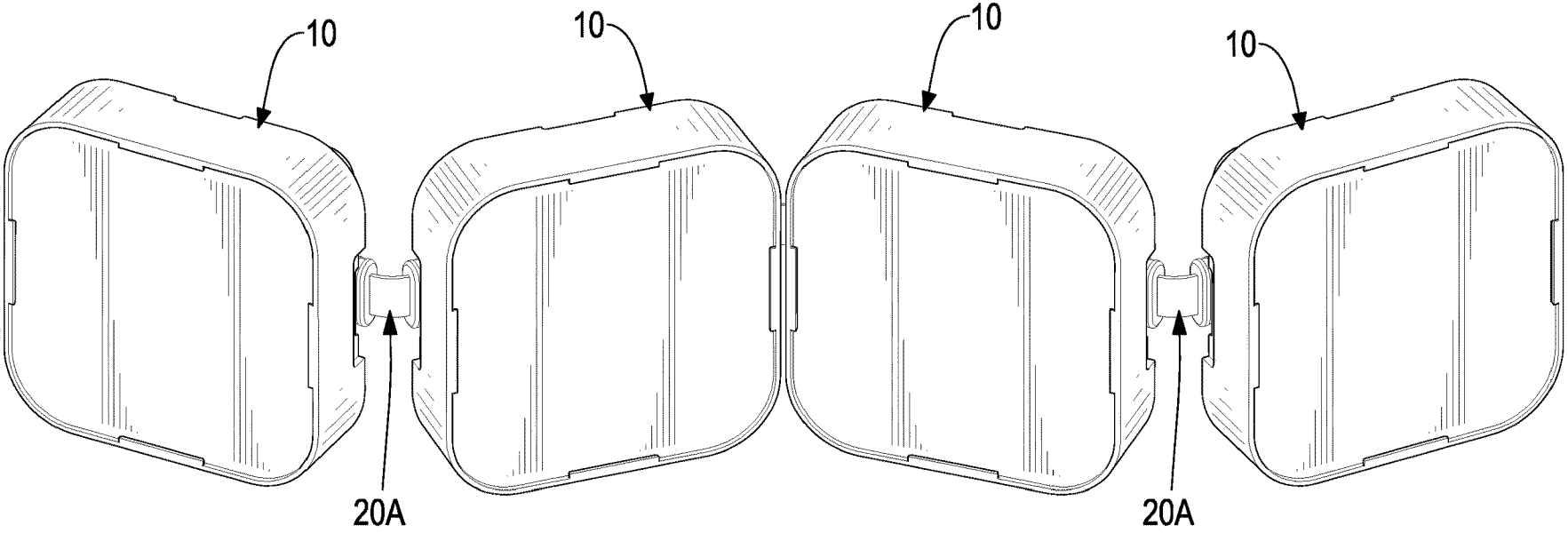
FIGS. 15 to 20 are perspective views of the illumination set in accordance with other configurations of the present invention.
Figure 16:
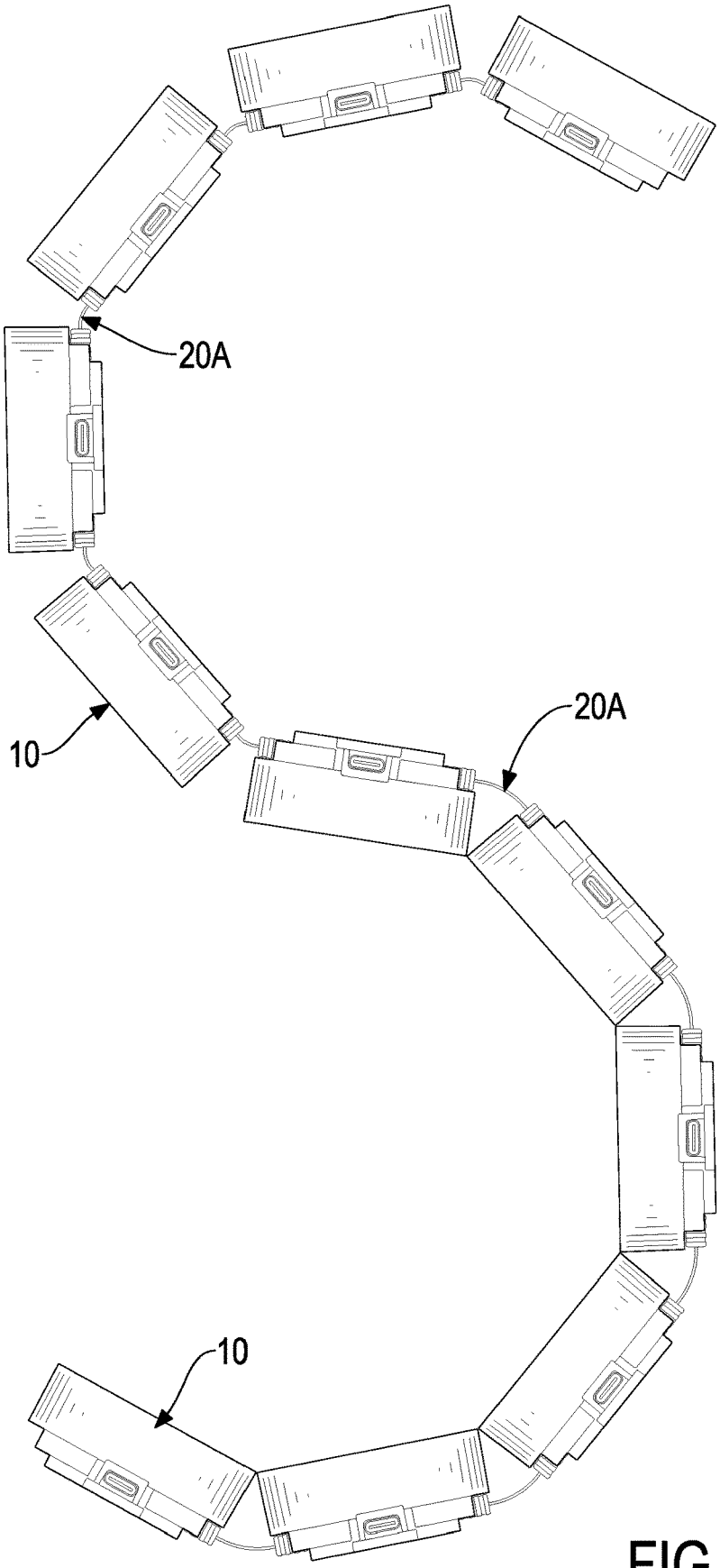
Figure 17:
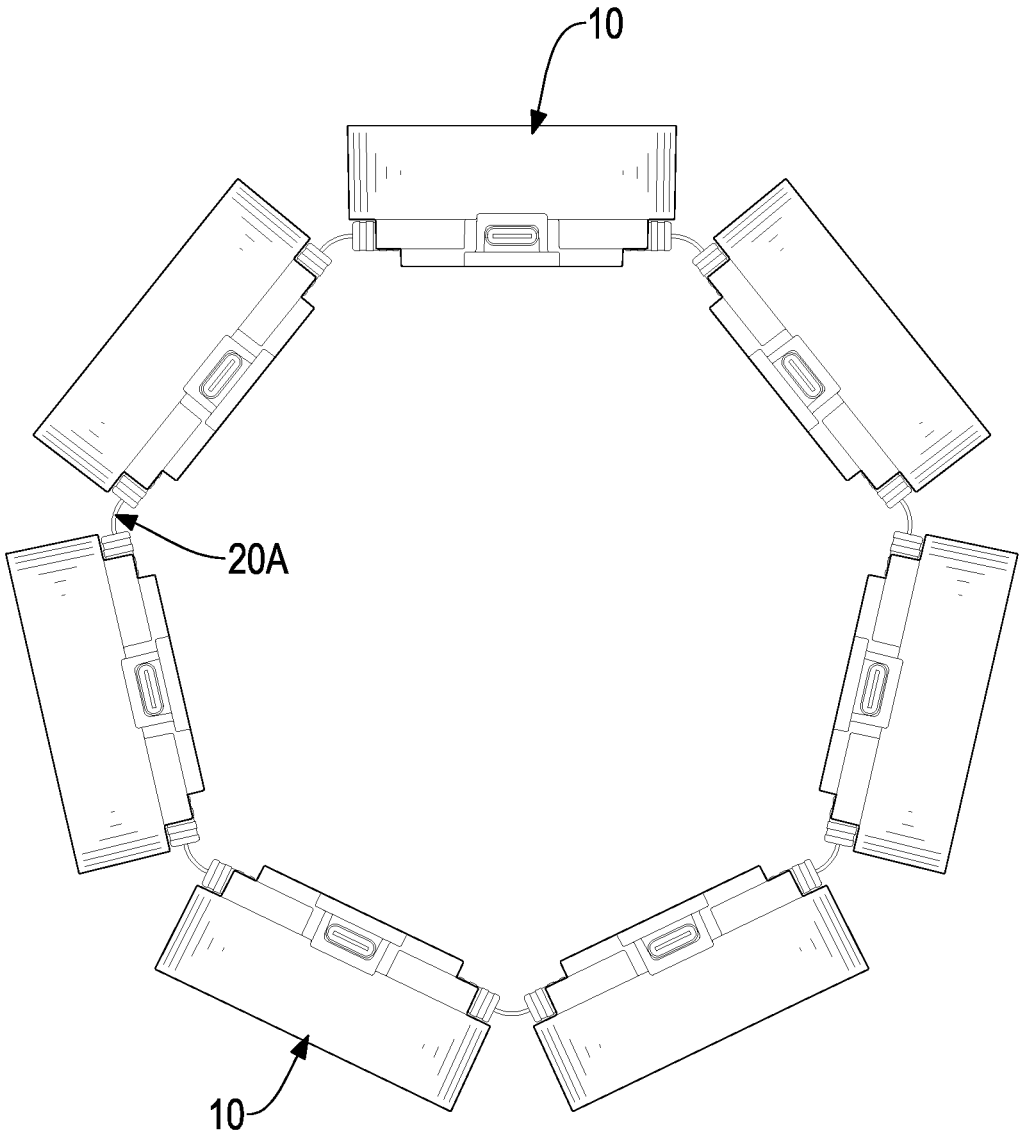
Figure 18:
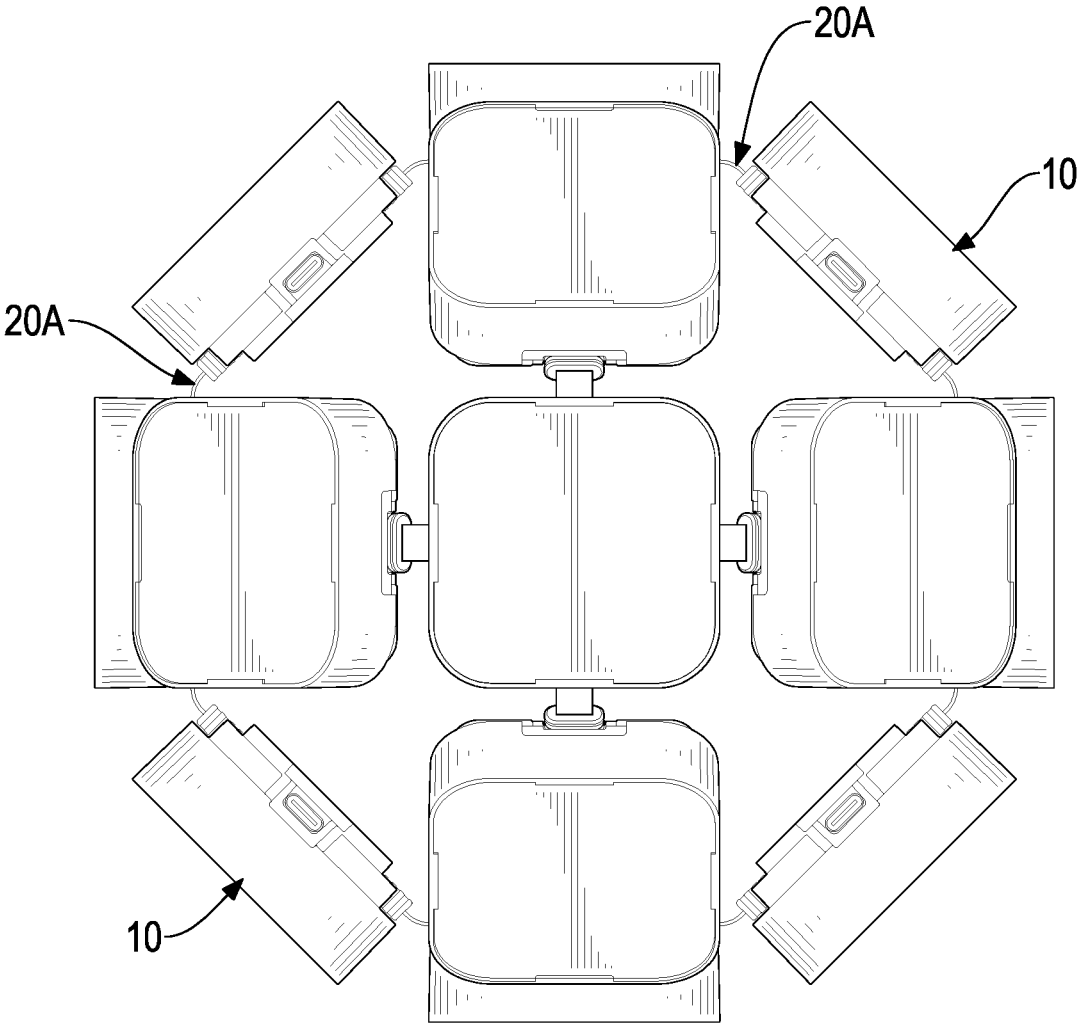
Figure 19:
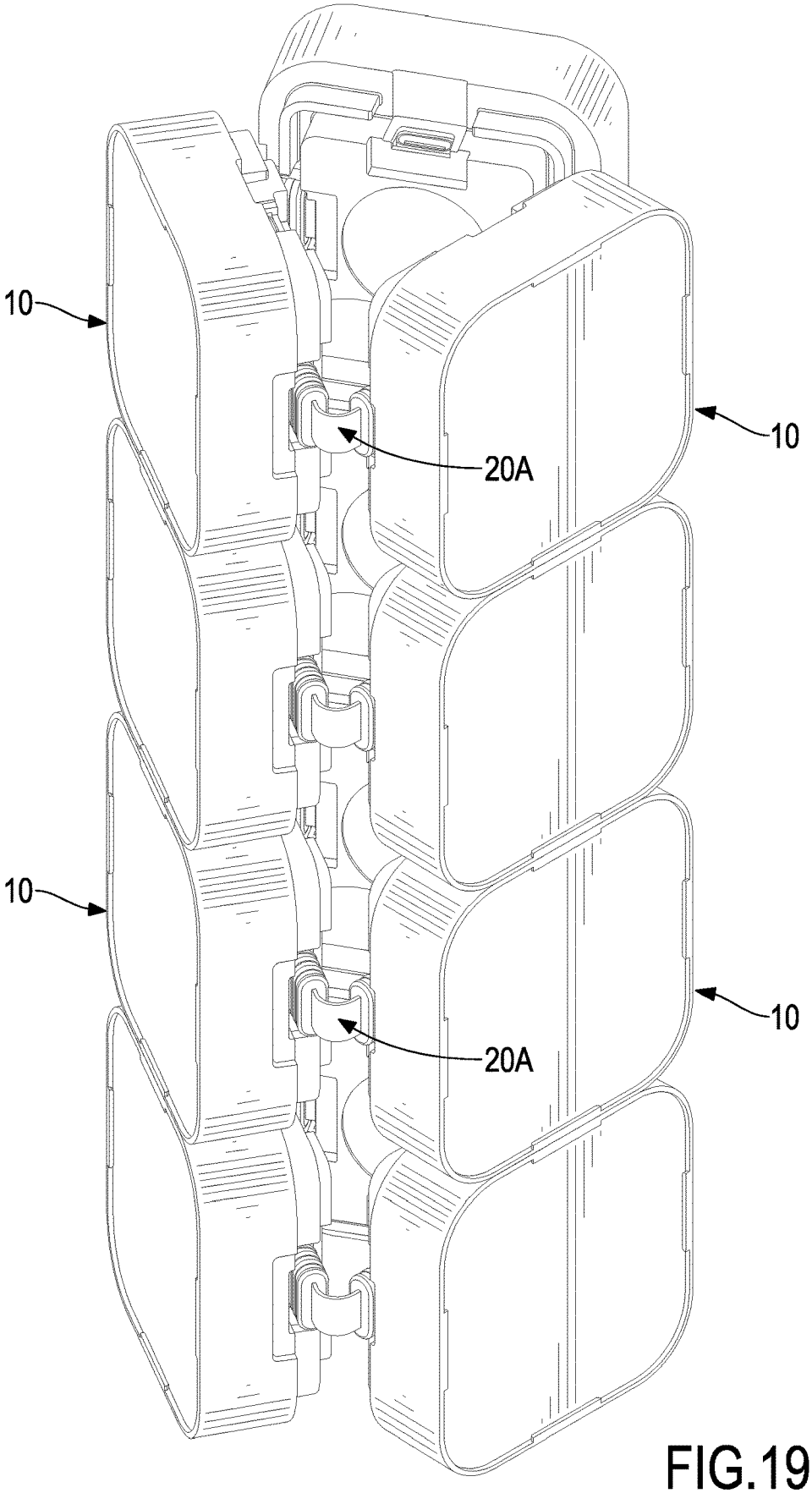
Figure 20:
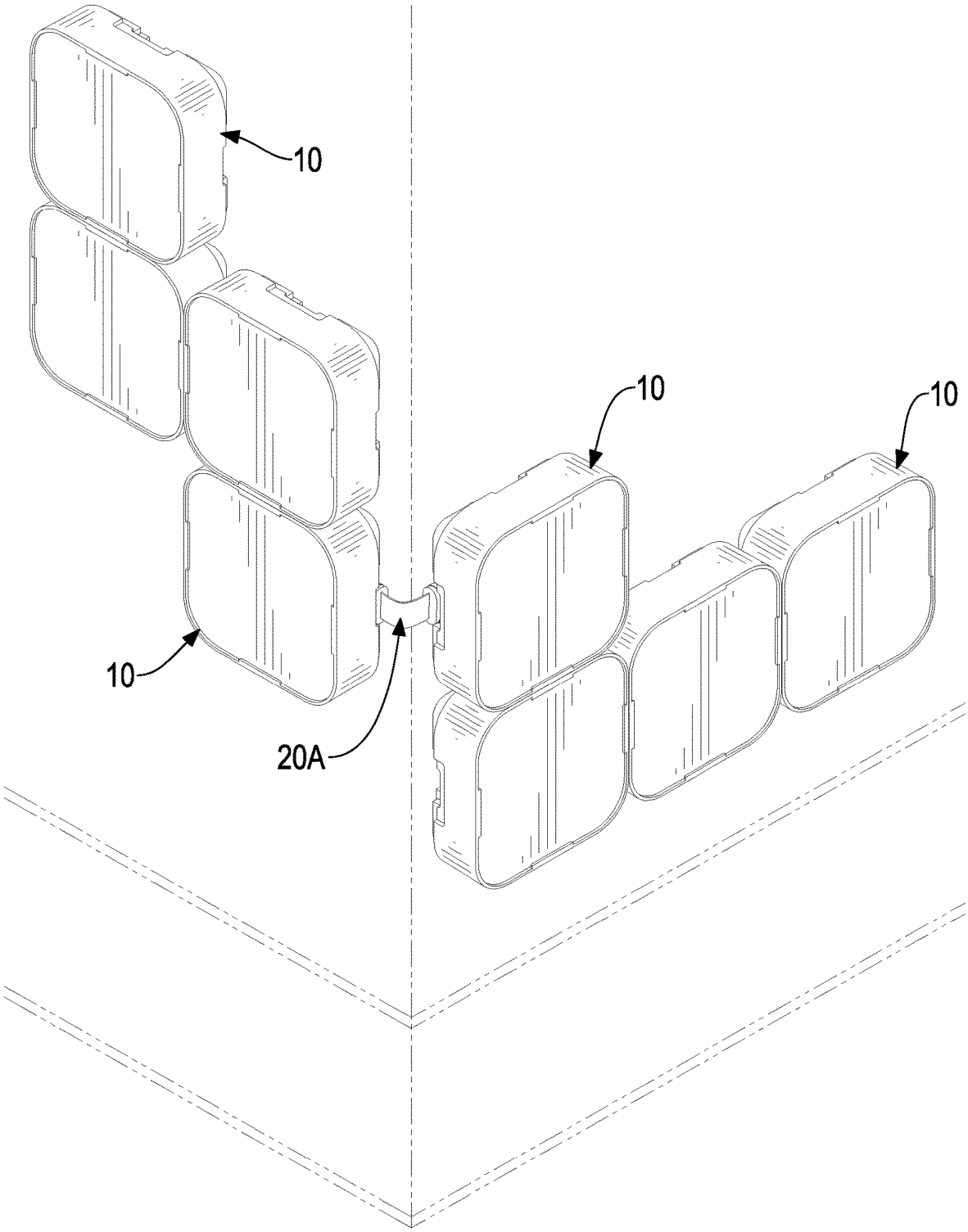

Please refer to FIG. 1 and FIG. 2. An illumination set is provided in accordance with the present invention. The illumination set comprises a plurality of alphabet lamps 10 and a plurality of connectors 20. The illumination set may selectively have a controller 30.

Then please refer to FIG. 3 to FIG. 9. Each one of the alphabet lamps 10 comprises an illumination module and the illumination module comprises a bottom casing 11, a top cover 12, an illumination circuit board 13, and a slide 14.

The bottom casing 11 comprises a bottom board 111, a plurality of side walls 112, a plurality of protrusions 113, and a plurality of connecting holes 114. The side walls 112 are mounted on the bottom board 111 and connected to each other. Therefore, the connected side walls 112 form a loop, and the side walls 112 and the bottom board 111 form a space therebetween. On the other hand, because of the loop of the side walls 112, the bottom casing 11 may be a triangle, quadrilateral, pentagon, hexagon, or octagon.

The protrusions 113 are mounted on the side walls 112 respectively. In this embodiment, each one of the protrusions 113 is mounted on an edge of a respective one of the side walls 112, and said edge is away from the bottom board 111. In this embodiment, the connecting holes 114 are formed through a bottom board 111, and a normal direction of each one of the connecting holes 114 is parallel with a normal direction of the side walls 112.

The top cover 12 is mounted on the bottom casing 11. Precisely, the top cover 12 is enclosed by the side walls 112. The top cover 12 is made of transparent material, such that light can pass through the top cover 12.

The illumination circuit board 13 is mounted in the bottom casing 11 and between the top cover 12 and the bottom board 111 of the bottom casing 11. The illumination circuit board 13 comprises a substrate 131, an illumination component 132, and a plurality of sockets 133. The illumination circuit board 13 selectively comprises a diverging lens 134.

The substrate 131 includes a first surface and a second surface opposite each other. The first surface faces the top cover 12, and the illumination component 132 is mounted on the first surface. The illumination component 132 may be a multicolor light-emitting diode. The diverging lens 134 is mounted on the substrate 131 and covers the illumination component 132, such that after passing through the diverging lens 134, the light emitted from the illumination component 132 can be evenly spread on the entire top cover 12. The sockets 133 are mounted on the second surface and respectively aligned to the connecting holes 114. The sockets 133 may be female ports; in this embodiment, the sockets 133 are, but not limited to, type-C female ports.

The slide 14 is a transparent sheet printed with a pattern. The pattern may be an alphabet, a number, a punctuation, a symbol, a logo, an emoji, etc. The pattern may be shaped as an alphabet, etc., or the pattern may form a hollow shaped in an alphabet, etc. Therefore, when the alphabet lamp 10 is turned on, the alphabet will be highlighted. The slide 14 is detachably mounted on the bottom casing 11. Precisely, the slide 14 is enclosed by the side walls 112 and located between the top cover 12 and the protrusions 113, such that the slide 14 is restricted by the protrusions 113. In other words, the top cover 12 is located between the slide 14 and the bottom casing 11.

Then please refer to FIG. 10 to FIG. 14. The connectors 20/20A/20B are configured of connecting two of the alphabet lamps 10. The connectors 20/20A/20B may have various lengths, so the alphabet lamps 10 may be connected side by side or spaced from each other, which allows the illumination set to display various information. Each one of the connectors 20/20A/20B comprises two plugs 21 and a bendable band 22. One of the plugs 21 is detachably inserted in one of the sockets 133 of one of the alphabet lamps 10, and the other one of the plugs 21 is detachably inserted in one of the sockets 133 of another one of the two alphabet lamps 10, and thereby power and signals are transmitted between two of the alphabet lamps 10 via connecting the sockets 133 and the connector 20/20A/20B. In this embodiment, the plugs 21 are, but not limited to, type-C male ports.

With the bendable band 22, the connected alphabet lamps 10 may form any angle. In this embodiment, the bendable band 22 may be made of a wire or a flexible printed circuit board. In another embodiment, the bendable band 22 may be made of a rigid printed circuit board.

Then please refer to FIGS. 15 to 20. With the bendable connector 20, the connected alphabet lamps 10 can form a line, a ring, a ball, or a polygonal column.

In the present invention, the illumination set has multiple alphabet lamps 10, and each alphabet lamp 10 can be controlled individually. Precisely, because the illumination circuit has a single-chip microcomputer controller, the alphabet lamps 10 can decide their order automatically after being connected, and thus the outer controller 30 may assign signals to any specific alphabet lamp 10 to turn on, turn off, flicker, show a specified color, change luminance, etc. Besides, the outer controller 30 may be connected to the illumination set via wired or wireless connection (e.g. infrared, Bluetooth, etc.). Therefore, the illumination set can be established not only on a desk, but also on a corner or outdoors, and thus the illumination set may be used as a signage for a store or vendor.

Because the slide 14 of the alphabet lamp 10 is detachable, the user can prepare many slides 14 with different patterns, and then mount the suitable slide 14 to transmit information.

Consequently, with such replaceable slide 14, one alphabet lamp 10 is not limited in providing the same pattern, so a set of the alphabet lamps 10 can display various information, which lowers the cost, and the usage of the illumination set is not limited to any specific information or situation. Besides, the only difference between the alphabet lamps 10 is the slides 14, so the manufacture process may be much simplified. Further, every pattern is illuminated by the same illumination component 132, so it is easy to keep all the alphabet lamps 10 in the same luminance.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An alphabet lamp comprising:

an illumination module comprising:

a top cover;

a slide detachably mounted on the top cover; a pattern formed on the slide;

a bottom casing engaging with the top cover;

an illumination circuit board located between the top cover and the bottom casing and mounted in the bottom casing; and a plurality of connecting holes;

a plurality of female ports mounted on sides of the illumination module;

wherein a plurality of the alphabet lamps are configured to be connected by a plurality of connectors to transmit power and signals, two of the alphabet lamps connected by one of the connectors, and each one of the connectors comprises:

two plugs, one of the plugs detachably inserted in one of the female ports of one of the alphabet lamps, and the other one of the plugs detachably inserted in one of the female ports of another one of the two alphabet lamps; and a bendable band made of a wire or a flexible printed circuit board, two ends of the bendable band connected to the two plugs respectively.

2. An illumination set comprising:

a plurality of alphabet lamps, each one of the alphabet lamps comprising:

a bottom casing;

a top cover mounted on the bottom casing;

an illumination circuit board mounted in the bottom casing and between the top cover and the bottom casing; the illumination circuit board having:

an illumination component; and a plurality of sockets;

a slide detachably mounted on the bottom casing; the top cover located between the slide and the bottom casing; a pattern formed on the slide; and a plurality of connectors, two of the alphabet lamps connected by one of the connectors; wherein each one of the connectors comprises:

two plugs, one of the plugs detachably inserted in one of the sockets of one of the alphabet lamps, and the other one of the plugs detachably inserted in one of the sockets of another one of the two alphabet lamps; and a bendable band, two ends of the bendable band connected to the two plugs respectively.

3. The illumination set as claimed in claim 2, wherein the alphabet lamps are capable of being connected in a line, a ring, a ball, or a polygonal column.

4. The illumination set as claimed in claim 2, wherein each one of the alphabet lamps is capable of being controlled individually.

* * * * *